US009615992B2

(12) United States Patent
Allen et al.

(10) Patent No.: US 9,615,992 B2
(45) Date of Patent: Apr. 11, 2017

(54) SYSTEM AND METHOD FOR SUPPLEMENTING CIRCULATION IN A BODY

(71) Applicant: LOCKHEED MARTIN CORPORATION, Bethesda, MD (US)

(72) Inventors: Edward Henry Allen, Bethesda, MD (US); Adam C. Salamon, Gaithersburg, MD (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 556 days.

(21) Appl. No.: 13/954,364

(22) Filed: Jul. 30, 2013

(65) Prior Publication Data

US 2015/0038888 A1 Feb. 5, 2015

(51) Int. Cl.
*A61H 11/00* (2006.01)
*A61H 9/00* (2006.01)

(52) U.S. Cl.
CPC ..... *A61H 9/0078* (2013.01); *A61H 9/0092* (2013.01); *A61H 2011/005* (2013.01); *A61H 2201/164* (2013.01); *A61H 2201/165* (2013.01); *A61H 2201/5002* (2013.01); *A61H 2201/5007* (2013.01); *A61H 2205/106* (2013.01); *A61H 2205/12* (2013.01); *A61H 2230/065* (2013.01); *A61H 2230/305* (2013.01)

(58) Field of Classification Search
CPC ..... A61H 9/00; A61H 9/005; A61H 9/0078; A61H 9/0085; A61H 9/0092; A61H 2011/005; A61H 11/00; A61H 11/02
See application file for complete search history.

(56) References Cited

U.S. PATENT DOCUMENTS 4,372,297 A * 2/1983 Perlin ..... A61H 9/0078 128/DIG. 20
5,263,473 A 11/1993 McWhorter
5,514,079 A * 5/1996 Dillon ..... A61H 9/0078 128/DIG. 20
5,674,262 A * 10/1997 Tumey ..... A61H 9/0078 128/DIG. 20

(Continued)

FOREIGN PATENT DOCUMENTS

EP 0388200 9/1990
EP 2445320 4/2012

(Continued)

OTHER PUBLICATIONS

Dohm et al., "Micro-mobile Foot Compression Device Compared with Pneumatic Compression Device," Clin. Orthop. Relat. Res., vol. 469. No. 6, Jun. 2011, pp. 1692-1700.

*Primary Examiner* — Valerie L Woodward
(74) *Attorney, Agent, or Firm* — Terry M. Sanks, Esq.; Beusse Wolter Sanks & Maire, PLLC

(57) ABSTRACT

A system including a compressible element configured to compress a muscle in a limb of a user, a controller configured to control a sequence, rate or amount of compression of the compressible element, and a generator configured to move a working fluid to compress the compressible element as controlled by the controller. The sequence, rate or amount of compression of the compressible element is established to reduce an amount of effort expended by a heart of a user to move a volume of blood. Another system and a method are also disclosed.

15 Claims, 4 Drawing Sheets

(56) References Cited

U.S. PATENT DOCUMENTS

| | | | | |
|---|---|---|---|---|
| 5,968,073 | A | 10/1999 | Jacobs | |
| 6,589,194 | B1 | 7/2003 | Calderon et al. | |
| 7,135,007 | B2 | 11/2006 | Scott et al. | |
| 7,755,257 | B2 | 7/2010 | Micallef | |
| 8,175,713 | B1 | 5/2012 | Cywinski | |
| 8,216,165 | B2 | 7/2012 | Ravikumar et al. | |
| 8,246,556 | B2 | 8/2012 | Mayer et al. | |
| 8,311,632 | B2 | 11/2012 | Pless et al. | |
| 8,394,043 | B2 | 3/2013 | Deshpande et al. | |
| 2005/0107725 | A1* | 5/2005 | Wild | A61H 9/0071 601/152 |
| 2006/0021261 | A1* | 2/2006 | Face | A43B 3/00 36/132 |
| 2007/0049853 | A1* | 3/2007 | Adams | A61H 9/0078 601/151 |
| 2008/0195018 | A1* | 8/2008 | Larson | A61B 17/1325 602/53 |
| 2010/0056966 | A1* | 3/2010 | Toth | A61H 23/0254 601/134 |
| 2011/0040220 | A1* | 2/2011 | Holgreen | A61H 9/0078 601/148 |
| 2011/0214315 | A1 | 9/2011 | Mayer et al. | |
| 2011/0218473 | A1 | 9/2011 | Farrow et al. | |
| 2012/0022413 | A1 | 1/2012 | Mayer et al. | |
| 2012/0065561 | A1* | 3/2012 | Ballas | A61H 9/0021 601/152 |
| 2012/0078146 | A1* | 3/2012 | Deshpande | A61H 9/0078 601/151 |
| 2012/0203132 | A1* | 8/2012 | Blumensohn | A61H 11/00 600/546 |
| 2014/0094726 | A1* | 4/2014 | Malhi | A61H 9/00 601/152 |
| 2015/0032039 | A1 | 1/2015 | Farrow et al. | |
| 2015/0257970 | A1* | 9/2015 | Mucke | A61N 1/0476 601/21 |

FOREIGN PATENT DOCUMENTS

| | | |
|---|---|---|
| FR | 2824471 | 11/2002 |
| FR | 2833467 | 6/2003 |
| FR | 2958535 | 10/2011 |
| SO | 2014194257 | 12/2014 |
| WO | 2011109725 | 9/2011 |
| WO | 2014109799 | 7/2014 |

* cited by examiner

SYSTEM AND METHOD FOR SUPPLEMENTING CIRCULATION IN A BODY

BACKGROUND

Embodiments relate to blood circulation within a body and, more particularly, to a system and method of using regulated compression to improve cardiovascular efficiency.

Muscles require a continuous supply of oxygenated blood to properly function and ward off fatigue. The ability of the body to perform perambulatory motion for an extended period of time is limited by various factors, some of which include genetics, physical fitness level, and cardiovascular efficiency. A subject, or user, has an ability to increase oxygen introduced into the subject's body to a genetic maximum efficiency ($VO_{2MAX}$) through exercise and training. Once $VO_{2MAX}$ is reached, the subject usually seeks to maintain this peak efficiency for as long as possible while continuing perambulatory motion.

The vasculature in the body includes veins which have one-way valves to prevent a backflow of blood. In the lower extremities, extra work is required to move blood uphill to the input side of the heart. Muscles assist the heart during perambulatory motion by compressing veins in the lower extremities and therefore provide assistance to the heart in returning blood uphill. The soleus muscle is one muscle which is part of the calf muscle and supports this function. Those skilled in the art have called the soleus muscle a second heart. Flexure of the soleus muscle provides assistive pumping of venous blood back to the heart from the periphery. Thus, process, namely, flexure of the soleus muscle, is generally known as the skeletal muscle pump, or the second heart effect. The soleus skeletal muscle pump is essential for maintaining adequate venous and interstitial fluid flows in the dependent body.

This process provides assistance to the heart by reducing the effort the heart must perform to maintain cardiovascular performance sufficient to accomplish the task or work at hand. This process is particularly important to soldiers, athletes, and other active individuals who depend on their hearts to maintain cardiovascular performance sufficient to accomplish the task or work at hand. Thus, such individuals would benefit from being able to increase benefits realized from flexure of the soleus muscle.

SUMMARY

Embodiments relate to a system and method for using regulated compression to improve cardiovascular efficiency. A system comprises a compressible element configured to compress a muscle in a limb of a user, a controller configured to control a sequence, rate or amount of compression of the compressible element, and a generator configured to move a working fluid to compress the compressible element as controlled by the controller. The sequence, rate or amount of compression of the compressible element is established to reduce an amount of effort expended by a heart of a user to move a volume of blood.

Another system comprises a sensing device configured to determine placement of a foot during a movement cycle of the foot, and a compressible element configured to assert pressure on a vein in association with a muscle of a user to produce increased blood flow within the vein. This system also comprises a controller configured to control a sequence, rate or amount of compression of the compressible element, information about a physiological cycle of the muscle with respect to the movement cycle of the foot, or information about at least one prior compression of the compressible element.

A method comprises creating movement of a working fluid with a generator, and supplying the working fluid to activate a compressible element surrounding a muscle in a limb of a user to compress. The method further comprises controlling a sequence, rate or amount of compression of the compressible element based on the movement of the working fluid provided to the compressible element with information about pressure applied to the pressure activated generator, information about a state of a heart of the user, information about a physiological cycle of the muscle or information about at least one prior compression of the compressible element to reduce an amount of effort expended by a heart of a user to move a volume of blood.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
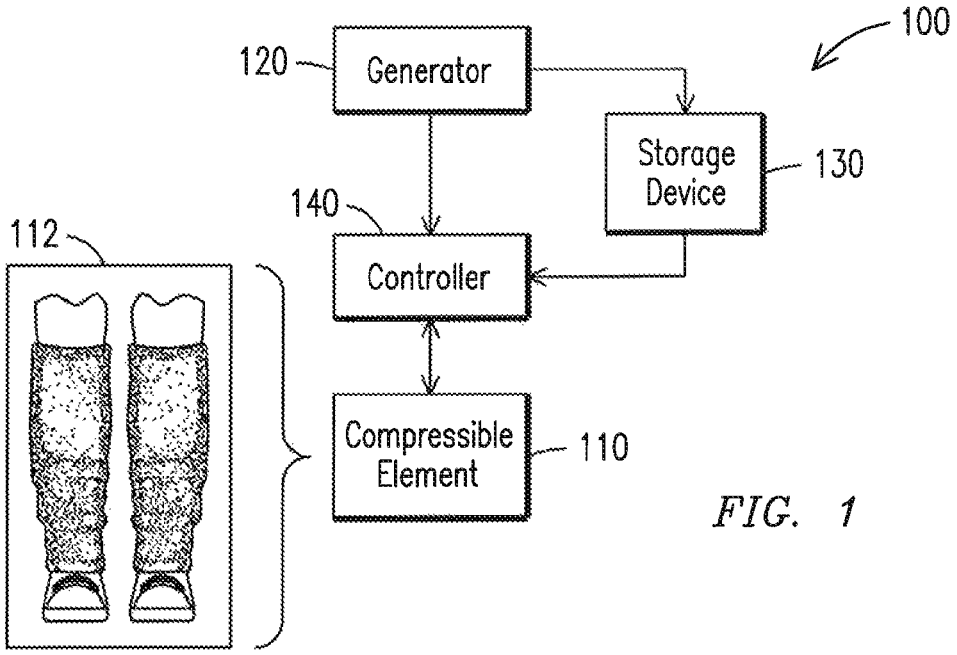
FIG. 1 shows a block diagram illustrating an embodiment of a system.

For the purposes of promoting an understanding of the principles and operation of the embodiments, reference will now be made to the illustrations in the drawings and specific language will be used to describe the same. The figures are not drawn to scale and they are provided merely to illustrate aspects disclosed herein. Several disclosed aspects are described below with reference to example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The disclosed embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. As a non-limiting example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 7.

As used herein, the terms "subject" and "user" are used interchangeably. As used herein, the term "subject" refers to an animal, preferably a mammal such as a non-primate (e.g., cows, pigs, horses, cats, dogs, rats, etc.) and a primate (e.g., monkey and human), and most preferably a human. The term "associated" or "association," as used herein, includes, but is not limited to, direct and indirect attachment, adjacent to, in contact with, partially or fully attached to, and/or in close proximity therewith.

The terms "fluid" or "working fluid" as used herein may comprise a form of electricity, liquid, and/or a gas which may be used as a catalyst to cause a compressible element to compress and release when fluid is no longer being activated or when compression of the compressible element is no longer necessary. Thus, as disclosed, the terms fluid or working fluid should not be considered limiting terms.

FIG. 1 shows a block diagram illustrating an embodiment of a system. As illustrated, the system 100 may comprise a generator 120 which provides movement of a working fluid to a storage device 130 and to, or through, a controller 140. More specifically, the controller 140 is provided to control a flow of the working fluid to a compressible element 110. As further illustrated, the working fluid at the storage device 130 may also flow to or through the controller 140 so that this fluid is also controlled by the controller 140.

As explained herein, the system 100 may function with a use of various types of fluid, wherein the elements of the system are configured to operate with the type of fluid used. Though embodiments described herein are disclosed as though elements of the system 100 are specific to a certain type of working fluid, the elements described herein are not limited for use with only a specific type of working fluid. Thus, as a non-limiting example, the generator 120, storage device 130, controller 140, and compressible element 110, may be configured to function with a particular working fluid, such as, but not limited to, a form of electricity considered as an electron gas, a gas, and/or a liquid. The generator 120 may be configured to either create the working fluid and/or to effect movement of the working fluid through the system 100 or both. Additionally, the system 100 may comprise use of more than a single type of working fluid. As a non-limiting example, the generator 120 may comprise a piezoelectric generator which may also be used to effect movement of a liquid or gas through the system.

Figure 3A:
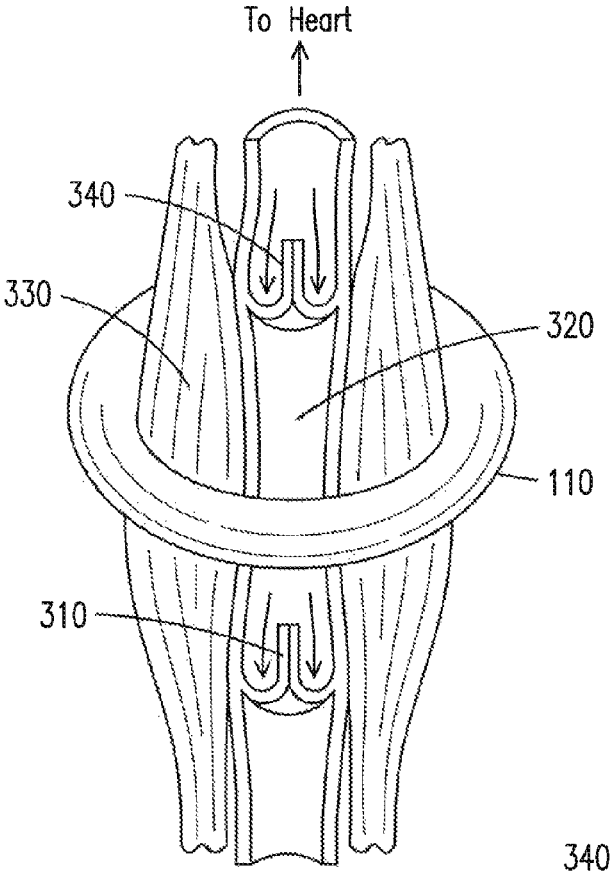
FIG. 3A shows a compressible element not compressed around the calf muscle.
Figure 3B:
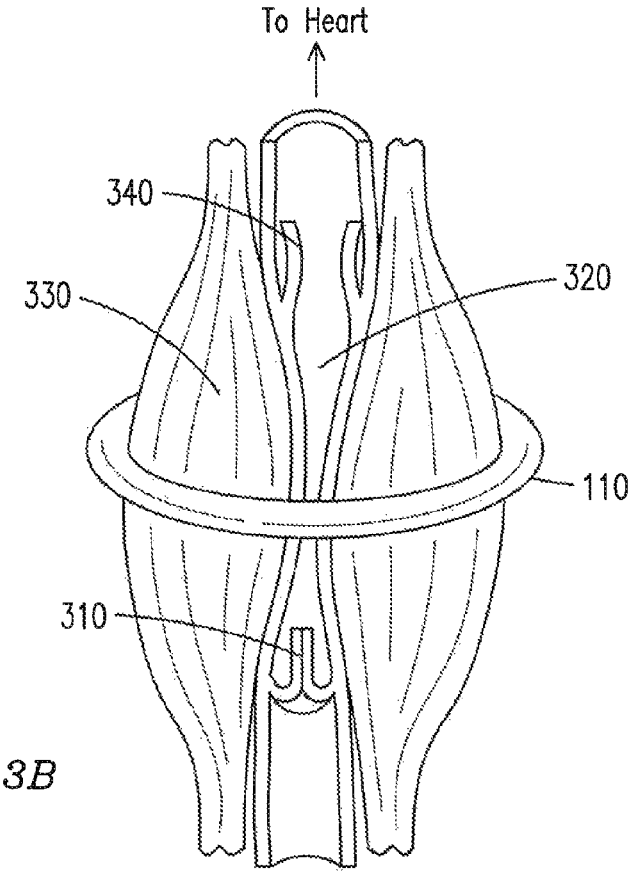
FIG. 3B shows the compressible element compressed around the calf muscle.

The system 100 comprises a compressible, or compressive, portion, element, component or cuff 110. The compressible element 110 may be configured to surround a limb, or extremity of a subject especially the calf muscle, as further illustrated in the pictorial representation 112 provided in FIG. 1, with respect to the compressible element 110. In another embodiment, the compressible element may not completely surround a limb or extremity, but is located to provide compression with respect to a vein 320 (as illustrated in FIGS. 3A and 3B). The compressible element 110 may be configured to compress the limb of the subject when activated. Compression and release of the compressible element 110 is effected by the state, or location, of the working fluid with respect to the compressible element 110.

As a non-limiting example, the compressible element 110 may comprise a synthetic dielectric elastomer. Thus, the compressible element 110 comprises an elastomeric film with electrodes on at least one side of the film. When an electrical signal, operable as the working fluid, such as, but not limited to, a voltage, is received, an electrostatic pressure acts on the electrodes which causes the film to constrict which results in compression of the compressible element 110. As explained below, the signal is provided by a controller 140 by way of power from a power storage device 130 or generator 120.

In another non-limiting example, the compressible element 110 may comprise a conduit, or pathway through which a gas or liquid may flow. When the gas or liquid is allowed to flow into the conduit, the compressible element 110 is configured to compress upon the limb or extremity.

Regardless of the working fluid used, the compressible element 110 may comprise a plurality of forms. In an embodiment, the compressible element 110 may be a part of leg warmers, which may be worn as a fashion statement about the calf, or soleus muscle of the subject. In an embodiment, the compressible element 110 may be a part of a leg sleeve as may be worn when participating in a sport, such as, but not limited to, basketball, about the calf muscle. In another embodiment, the compressible element 110 may be a part of a legging, such as may be worn while exercising, wherein the compressible element 110 is located about the calf muscle. Other non-limiting embodiments are possible; therefore, those disclosed herein are not meant to be limiting.

The system 100 further comprises a power source, or generator, 120, such as, but not limited to, a piezoelectric generator or a compressive generator to effect transportation of a liquid or gas, configured to provide the working fluid to the compressible element 110. More specifically, the generator 120 is provided to power the compressible portion 110 to compress and decompress (where decompression occurs when a signal is no longer provided to the compressible element 110) a muscle (such as, but not limited to, the calf muscle) of the limb or extremity of the subject. As explained in further detail herein, in an embodiment the generator 120 may be configured to harvest energy that is not used, or wasted, during movement of at least one limb on the subject. In another embodiment, the generator 120 may comprise a piezoelectric transducer, which differs from a piezoelectric material as described above as the piezoelectric transducer ("PZT") may comprise a single layer of material which when deformed, such as, but not limited to, being flexed, generates an electrical charge.

As further illustrated in FIG. 1, a storage device 130 may be provided. The storage device 130 may be in communication with the generator 120 and the controller 140. The storage device 130 may provide an ability to store, or retain, the working fluid, which may be a compressed gas, a liquid, or a state of electricity, generated or transported by operation of the generator 120 for use with the system 100 currently or for later use. When the working fluid is in the form of electricity, the storage device 130 may comprise a capacitor, or another device to hold the form of electricity. When the working fluid is in the form of a liquid or gas, the storage device 130 may comprise a tank or another contained device capable of holding the working fluid specific to the composition of the working fluid.

In a non-limiting example, namely, when the working fluid is a form of electricity, instead of providing power directly from the generator 120 to the compressible element 110, as controlled by the controller 140, power for the compressible component 110 may be provided from the storage device 130. Thus, in this non-limiting example, during perambulatory or other iso-dynamic motion, power (electricity) generated by the generator 120 is supplied to the storage device 130, thus replenishing the power removed from the storage device 130 during operation of the compressible element 110. In a similar manner, and in another non-limiting example, during perambulatory or other iso-dynamic motion, compressed air or gas may be provided in the storage device 130, as actuated by the generator 120, thus replenishing the power removed from the storage device 130 during operation of the compressible element 110. The controller 140, as provided may be in communication with the compressible element 110 and the generator 120. The controller 140 may also be in communication with the storage device 130. The controller 140 may be configured to receive data and information from the compressive element 110 and the generator 120 for further operation of the compressible element 110, thus collectively creating a feedback circuit.

As a non-limiting example, the controller 140 may be a microelectronic controller. In another non-limiting example, the controller 140 may be in direct or indirect connection with the other elements in the system 100. Thus, a direct connection may be a wired connection whereas an indirect connection may be a wireless connection. The controller 140 may be used to control an opening and/or closing of a valve or gate in the system 100 to regulate the compression of the compressible element 110. Through the controller 140 and/or compressible element 110 at least one sensor may be provided to measure the user's pulse, heart rate, blood pressure, and/or compression rate to determine when to provide compression. Based on the information collected, the controller 140 may determine the compressions of the compressible element 110 to more effectively assist the heart.

Figure 2:
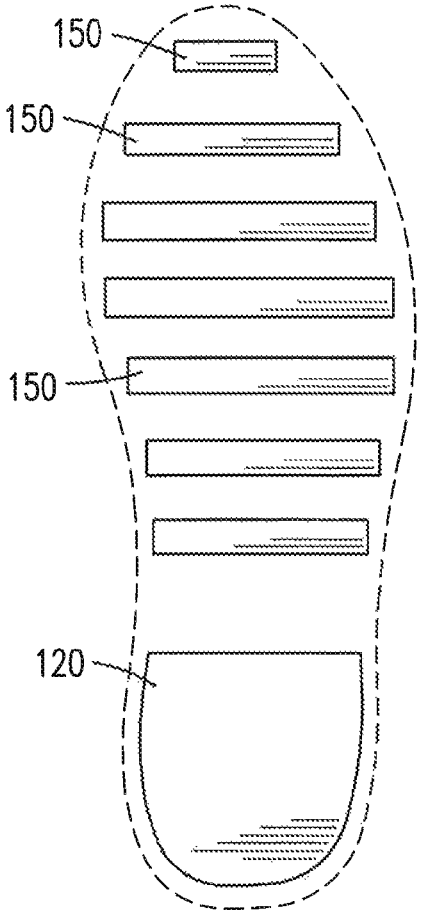
FIG. 2 shows a block diagram illustrating an embodiment of a part of the system.

FIG. 2 shows a sole of a piece of footwear with an embodiment of a part of the system. The article of footwear may include, but is not limited to, a shoe, a sock, a soft cast, a leg warmer, or any other type of article which surrounds a limb of a subject. Thus, the use of the term "sole" with respect to footwear is not meant to be limited to a shoe, but a bottom part or bottom side of the piece of footwear. The generator 120 is disclosed in a heel location of the sole. Though disclosed in the heel, the generator 120 may be located at any location on the sole. Furthermore, though being illustrated as being located on the sole, the generator 120 may be located on another article that may be worn by the subject with respect to any part of the body, such as, but not limited to, a hand covering (as may be worn when lifting weights or playing a sport in which a hand engages an object). Thus, even though FIG. 2 is shown with respect to a sole of a piece of footwear, this embodiment is not limiting.

In an embodiment, the generator 120 may comprise a synthetic dielectric elastomer material which is a pseudo-piezoelectric material. The elastomer may comprise an elastomeric film with electrodes on at least one side. Unlike natural piezoelectric material, an initial charge is needed to initiate charging characteristics of the pseudo-piezoelectric material. To provide the initial charge, a battery may be provided. In another embodiment, the storage device 130 may provide the initial charge. Thus, the storage device 130 may comprise a battery or capacitor, or in other embodiments as disclosed above in which air is the working fluid, the storage device 130 may comprise compressed air or liquid within a tank or canister.

When pressure is applied to the generator 120, such as when the subject's foot presses down upon a surface of the generator, the electrodes are brought closer together increasing an electric field which produces a charge. As explained further herein, this increased electric field is driven, directed or provided, to the power storage device 130 and/or controller 140. As described above, in other embodiments, the generator 120 may include a pressurized air or liquid device, wherein when the user compresses or provides pressure or flexure to the generator 120, pressurized air or liquid can be provided to the compressive element 110 to compress the limb of the subject.

A sensing device, also referred to as at least one strip, 150 is also provided on the sole. As illustrated, a plurality of strips 150 is shown. The sensing device, or at least one strip, 150 may be provided to determine a position of the subject's foot within a movement cycle. This position information is provided to the controller 140 for use in controlling compressions of the compressible element 110. The at least one strip provided may comprise a dielectric elastomer, in one non-limiting example. In another non-limiting example, the at least one strip 150 may comprise a liquid-filled or gas-filled bladders such that, in one example, once pressure is applied to the bladder(s), information about the position of the subject's foot within the movement cycle can be received and transferred to the controller 140 and/or to the user. Furthermore, in another embodiment, the generator 120 may comprise one or more air or liquid-filled bladders wherein compression may provide power to the system 100 and compress the compressible element 110 when a subject compresses the bladder(s) by walking or shifting weight onto or providing a force onto the bladder(s).

In another non-limiting example, compressed air may be the working fluid. The compressed air may be connected to the compressible element to compress the compressible element as commanded by the controller 140 which controls the compression rate, timing, amount and sequence. The generator may be a pump system. As a non-limiting example, the pump system may be located in a sole of a piece of footwear wherein footsteps of a user, which would apply pressure to the pump system, compresses the pump or pumps in the pump system to cause movement of air (a gas) through the system 100 and eventually to the compressible component 110. Deflation of the compressible component 110 can occur through a valve. In a non-limiting example, a two way valve may be provided so that the gas may pass through either direction of the tube or conduit through which the working fluid flows to the compressible element 110. Thus, a pressurized air, or gas, is released into the compressible component 110 to effect the compression. The rate, timing, and amount of pressurized air released to the compressible component 110 may be controlled by the controller 140 as well as the deflation of the compressible component 110. In another non-limiting example, steps by the user of the system 100 may provide air to be supplied to an air tank, or power storage 130, by which this compressed air may be delivered to the compressible element 110 to compress the calf or soleus muscle. The aforementioned examples may also be used with a liquid in the place of or in combination with the air as the fluid of the system 100.

In another non-limiting example using a combined gas and electric system, the generator 120 may be a gas containing device, such as, but not limited to, a gas-filled bladder system which may comprise one or more bladders. The gas-filled bladder system may be placed under or adjacent to the foot of the subject such that one or more air containing bladders may be compressed by movement of the subject's foot and this movement may be used to drive a turbine within the bladder system to generate power to power the system 100.

FIG. 3A shows a compressible element not compressed around the calf muscle and FIG. 3B shows the compressible element compressed around the calf muscle. As illustrated in FIG. 3A, when the compressible element 110 is not compressed, or is in an inactive state, the muscle may be relaxed and a first valve 310 of a vein 320 passing through the soleus muscle 330 and a second valve 340 located after the vein 320 has passed through the soleus muscle 330 are both closed. In another embodiment, the muscle may be flexed. When the compressible component 110 is compressed, or is in an active state, as illustrated in FIG. 3B, the calf muscles 330 are contracted by the compression of the compressible element 110 which opens the second valve 340 to result in an increase supply of blood flowing to the heart of the subject. Thus, when utilizing an embodiment disclosed herein, by tapping into the excess (and otherwise wasted) gravitation energy arising from the act of the subject shifting weight from one leg to the other during perambulation or other iso-dynamic exertion, a reduction in an effort the heart exerts to maintain cardiovascular performance is realized thereby increasing an efficiency of the cardiovascular system of the subject. In another embodiment, the compressible element 110 may be compressed based on a timing of the heart beat (heart rate) of the subject, of which information may be received from one or more of the sensors described herein. Thus, the compressible element 110 may be compressed based on a cycle of a heartbeat, a condition or state of a muscle, or a combination thereof. When considering the state of the muscle, timing of contractions of the compressible element 110 may be tuned to or operated at a physiological cycle of the calf muscle to align its phasing to minimize exertion of the heart. As a non-limiting example, at a time that weight is shifted to a first leg of the user, the soleus muscle is already flexed; therefore, this may not be a time where the compressible element 110 should be compressed. Applying compression at this time may result in the compressible element 110 operating out of phase with respect to the heart and circulation functions of the body, if an intent is for it to operate in phase.

The physiological cycle of the calf muscle may be assessed by compressions experienced by the generator 120, information obtained from the sensing device 150 regarding a step taken by the subject, which is communicated to the controller, and/or heart rate of the subject's heart. When compressed, a signal is communicated from the compressible element 110 to the controller 140 to provide feedback to the controller 140. The controller is further configured to control timing and shape of a pulse, or signal, communicated to the compressible element 110 to perform a compression. The shape of the pulse may be selected or regulated based on a desired amplitude of a heart pulse measured at the soleus or calf muscle. Therefore the desired amplitude measured at the soleus or calf muscle may be as strong as the user's heart or at another amplitude, such as, but not limited to, twice as strong or half the amplitude, of the heart of the user.

When compression occurs in relation to the heart beat of the user, in a non-limiting example, the compressible element 110 may be compressed in unison with the rate of the heart beats of the subject. In another non-limiting example, compression of the compressible element 110 may occur between heart beats of the subject. In another embodiment, compression of the compressible element 110 may be based on a combination of the condition or state of the calf muscle and the rate of heart beats of the subject.

By using pseudo-piezoelectric materials as disclosed in some embodiments herein, and by using electric current as a form of fluid passing from the generator 120 to the compressible component 110, a nearly incompressible fluid is realized where it is only compressible exponentially when compared to water or air which are both mainly compressible linearly. As a non-limiting example, if a volume of electric current was to be decreased by half; an increase in pressure by several orders of magnitude is realized whereas with air, decreasing a volume of air by half, the pressure is increased by four. Furthermore, unlike using air or water, using electricity as the fluid does not create heat. Moreover, a response rate with electricity is faster than other fluids. Having a faster response rate provides for being able to utilize various types of sequence of compressions, rate of compress or amount of compression when compared to using other fluids.

In operation, as a non-limiting example, if an arbitrary volume is cycled between a pressure of (nominally) zero and one equal to the pressure on the soles of the feet of the subject when standing on one leg, the energy change is roughly 0.067 Joules per unit volume (e.g., typical static pressures are of order 60 kilopascal ("kPa"), while walking and running pressures can peak at ten times that or more). For a typical human footprint, a volume change of 10 $cm^2$ may be realized which may result in 0.67 Joules (the typical human footprint is of an order of 100 $cm^2$ and so a one millimeter compression or other deflection in the sole of the foot would indicate a volume change of 10 $cm^2$). If the subject strides at a rate of one per second (this is very nearly a typical, natural "preferred stride rate" for most humans, estimated at 54.6/minute), the available power which may be generated is approximately 0.67 watts. Fast walking and running can drive these values to 10 watts or more. It is important to make the point that this is power intrinsic to perambulation without imposing any additional load, that is, it is "waste energy" in the sense that harvesting it entirely would place no additional work burden on the perambulator. The embodiments disclosed herein do not provide any additional load on the subject.

The human heart pumps blood at roughly 13.3 kPa (ignoring pulsate flow variations) and beats about 75 bpm at rest and more than twice that under exercise. Measurements of heart flow rates are of the order of 0.1 liters per second ("L/s"). Thus, an average power output is approximately 1.33 watts (the product of pressure and flow rate in volume per second). Assuming that pumping efficiency of the heart is about 25 percent ("%"), an input energy requirement for the heart is about 5.32 watts. Thus, since a surplus power from perambulation is plenty to replace, entirely, the heart's output power. Moreover, because the heart is believed to be relatively inefficient (in a strict thermodynamic sense at 25%), cutting an output requirement for the heart by even a few percentage points may cut the heart's power input requirement by four times that amount. Such an input reduction accomplishment saves a measureable amount of energy for other uses of the athlete, soldier, or laborer including, but not limited to, applications to other muscle groups thus enhancing performance and stamina. For many athletes and athletic endeavors, especially where endurance is a factor, a few percentage points in performance may be a difference between winning and losing.

Figure 4A:
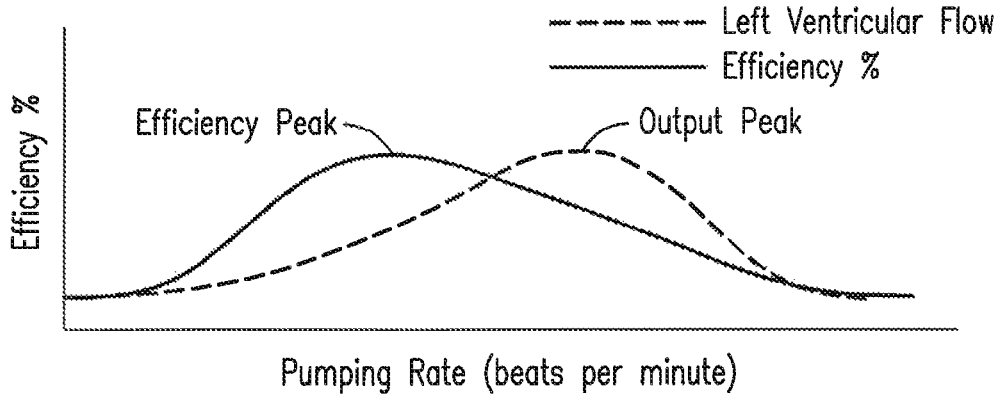
FIG. 4A shows a graphical representation of efficiency and blood flow versus pumping rate of a heart.
Figure 4B:
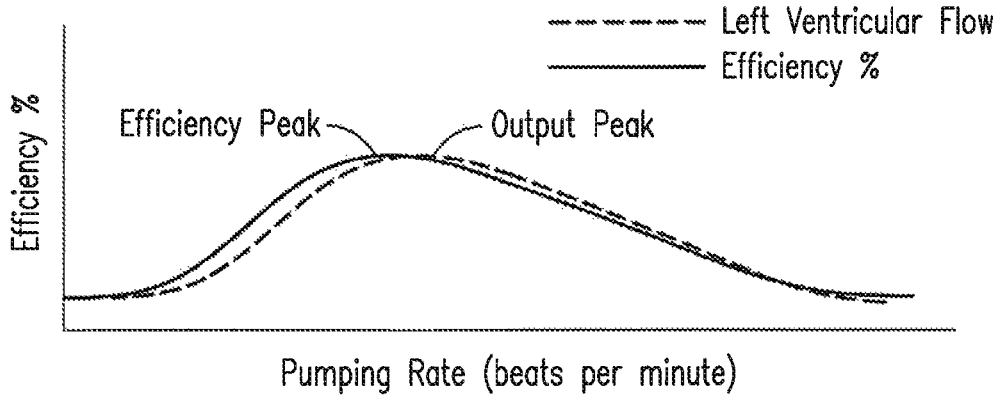
FIG. 4B shows a graphical representation of efficiency and blood flow versus pumping rate of a heart when using an embodiment of the system.

FIG. 4A shows a graphical representation of efficiency and blood flow versus pumping rate of a heart and FIG. 4B shows a graphical representation of efficiency and blood flow versus pumping rate of a heart when using an embodiment of the system. As illustrated in FIG. 4A, peak efficiency of the heart is realized at a slower heart rate, bpm, than peak output flow of blood from the heart when considering the left ventricular flow. As illustrated in FIG. 4B, utilizing an embodiment of the system or method discussed above, the peak efficiency and peak performance (blood flow) are more equalized so that the peak blood flow occurrence is at a lower heart rate, preferably at a rate closer to the efficiency peak of the heart.

Figure 4C:
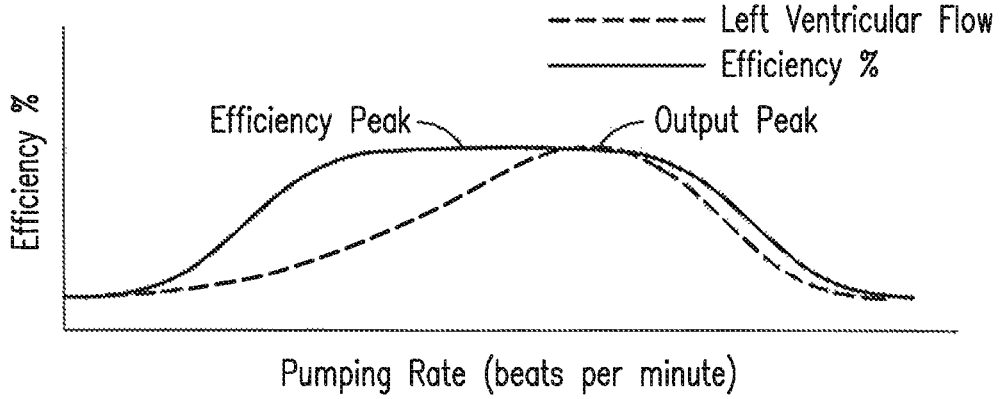
FIG. 4C shows a graphical representation of efficiency and blood flow versus pumping rate of a heart when using an embodiment of the system.

FIG. 4C shows a graphical representation of efficiency and blood flow versus pumping rate of a heart when using an embodiment of the system. As illustrated, the system 100 may be configured to assist in aiding during recovery periods of the subject's cardiovascular system as well as during peak performance periods. This is demonstrated by an extension of the efficiency percentage curve to remain at or near its peak efficiency through the peak output flow of blood from the heart when considering the left ventricular flow. The system 100, therefore may assist the subject even at times outside of the peak efficiency range and thus increase the user's blood flow efficiency across a full spectrum of when the efficiency peak is reached through when the output peak is realized.

Figure 5:
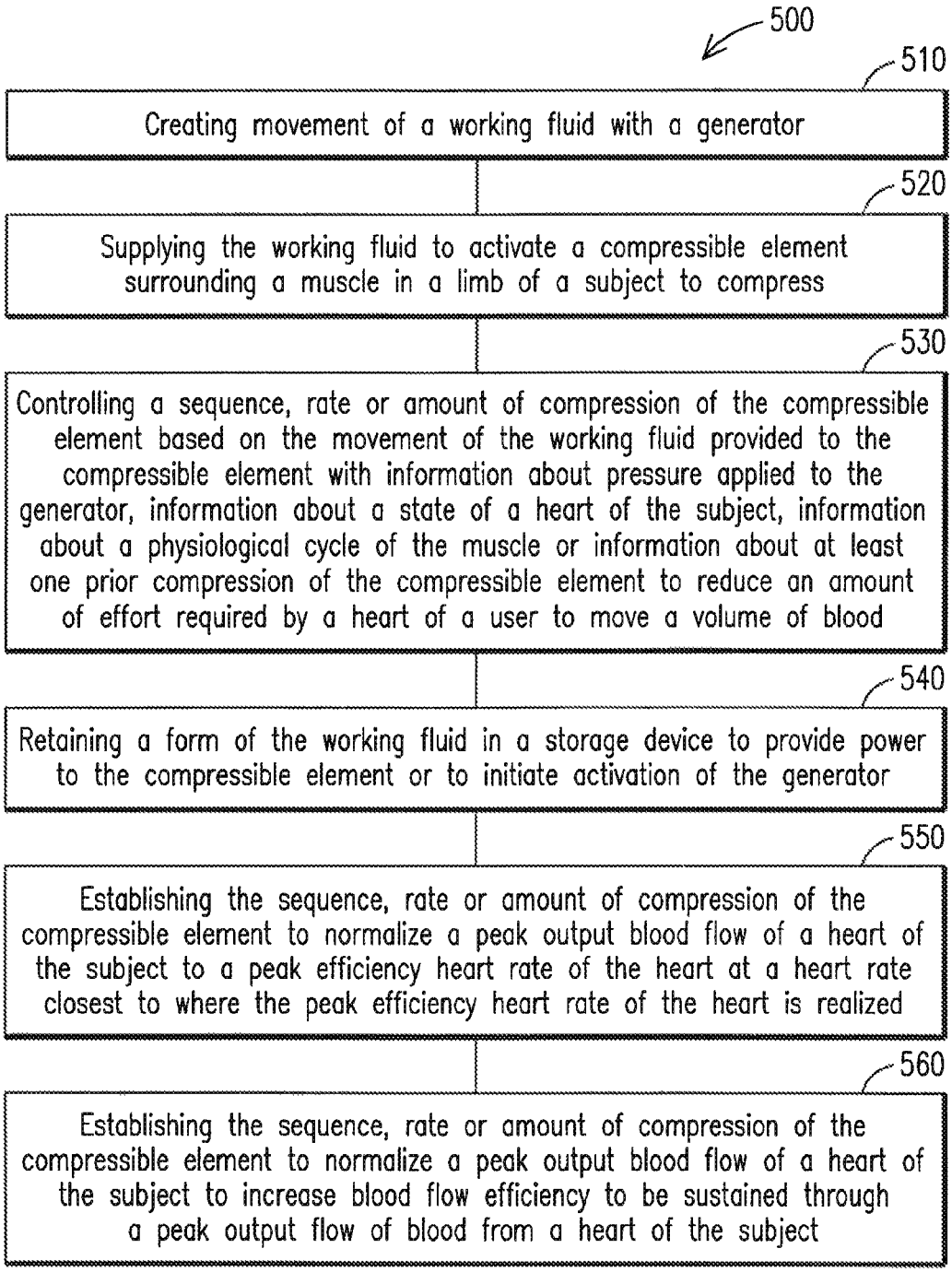
FIG. 5 shows a flowchart illustrating an embodiment of a method.

FIG. 5 shows an embodiment of a flowchart of an embodiment of a method. The method 500 comprises creating movement of a working fluid with a generator, at 510. The method further comprises supplying the working fluid to activate a compressible element surrounding a muscle in a limb of a subject to compress, at 520. The method further comprises controlling a sequence, rate or amount of compression of the compressible element based on the movement of the working fluid provided to the compressible element with information about pressure applied to the generator (such as, but not limited to, a pressure activated generator), information about a state of a heart of the subject, information about a physiological cycle of the muscle or information about at least one prior compression of the compressible element to reduce an amount of effort expended by a heart of a user to move a volume of blood, at 530.

The method may further comprise retaining a form of the working fluid in a storage device to provide power to the compressible element or to initiate activation of the generator, at 540. The method may further comprise establishing the sequence, rate or amount of compression of the compressible element to normalize a peak output blood flow of a heart of the subject to a peak efficiency heart rate of the heart at a heart rate closest to where the peak efficiency heart rate of the heart is realized, at 550. The method may further comprise establishing the sequence, rate or amount of compression of the compressible element to normalize a peak output blood flow of a heart of the subject to increase blood flow efficiency to be sustained through a peak output flow of blood from a heart of the subject, at 560. Creating movement, at 510, may further comprise disposing the generator within a sole of a piece of footwear such that a perambulatory motion of a foot of the subject provides pressure to the generator to create the movement of the working fluid.

Though the method 500 is illustrated as having steps performed sequentially, the method is not limited to the sequence disclosed. The steps may be performed in any sequence; therefore, the embodiment of FIG. 5 should not be considered limiting.

Embodiments described herein are configured to reduce a workload of the heart muscle, and by doing so may enhance cardiovascular performance leading to extended activity duration without fatigue. The embodiments increase an efficiency of the subject to perform perambulatory motion for an extended duration by providing an article of clothing capable of assisting in and effectively synchronizing compression of the lower leg venal network by the calf or soleus muscle and a piezoelectric generator fueled by the pulsed pressure of footsteps to power the assistive clothing. This effect can be achieved by a lightweight article of clothing which would avoid adding weight to the subject wearer. Additionally, in an embodiment, no external power source is required to power the system. The embodiments are able to supplement the skeletal-muscle pump (second heart) as an auxiliary pump and provide matching of the heart's efficiency peak and outflow peak, which are otherwise known to occur under different working conditions. Operating at a new systemic optimized output point, at a rate closer to the heart rate for the efficiency peak, offers a unique advantage in stamina and performance.

Another use of the embodiments disclosed herein may include, but are not limited to, enhanced physical performance and acceleration of muscle recovery as a massage of the calf muscles (i.e., soleus) immediately after ambulatory exercise has been shown to greatly reduce the exercise-induced inflammation and accelerate the recovery process. Yet another use of embodiments disclosed herein may include, but are not limited to, improve removal of waste products through improved circulation. By doing so, reduced fatigue and mitigating post-exertion muscle pain resulting from perambulation or iso-dynamic exertion may be realized.

Though the embodiments as described with respect to the soleus and/or calf muscle, skeletal-muscle pump (second heart), the embodiments may be applied to other muscles or limbs of the body. As a non-limiting example, embodiments may be used with a muscle associated with an arm, such as the biceps brachii, where such use of an embodiment may be in combination with an embodiment being applied to the soleus and/or calf muscle.

Additionally, since the pumping of blood through the soleus muscle is capable of providing sufficient circulation of blood through a body in place of the heart, embodiments described herein may be used to assist with blood circulation when the subject has a damaged heart.

Thus, embodiments provide benefits to various subjects, such as, but not limited to, soldiers and athletes, by reducing an amount of effort which may be normally required, or expended, by the heart to move a volume of blood, by more effectively using the second heart of the subject, also known as the skeletal-muscle pump. Embodiments result in providing mechanical compression of certain muscles in the limb (s), such as, but not limited to, the lower limb(s), of the subject thereby relieving the heart of a portion of the output it would otherwise have to endure to support the subject during performance of certain activities or tasks by harnessing the excess (and otherwise wasted) gravitational energy arising from the act of the subject shifting weight from one leg to another during perambulation or other iso-dynamic exertion.

It is important to an understanding of the embodiments to note that all technical and scientific terms used herein, unless defined herein, are intended to have the same meaning as commonly understood by one of ordinary skill in the art.

While various disclosed embodiments have been described above, it should be understood that they have been presented by way of example only, and not limitation. Numerous changes to the subject matter disclosed herein can be made in accordance with the embodiments disclosed herein without departing from the spirit or scope of the embodiments. In addition, while a particular feature may have been disclosed with respect to only one of several implementations, such feature may be combined with one or more other features of the other implementations as may be desired and advantageous for any given or particular application.

Therefore, the breadth and scope of the subject matter provided herein should not be limited by any of the above explicitly described embodiments. Rather, the scope of the embodiments should be defined in accordance with the following claims and their equivalents.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Thus, while embodiments have been described with reference to various embodiments, it will be understood by those skilled in the art that various changes, omissions and/or additions may be made and equivalents may be substituted for elements thereof without departing from the spirit and scope of the embodiments. In addition, many modifications may be made to adapt a particular situation or material to the teachings of the embodiments without departing from the scope thereof. Therefore, it is intended that the embodiments not be limited to the particular embodiment disclosed as the best mode contemplated, but that all embodiments falling within the scope of the appended claims are considered.

What is claimed is:

1. A system comprising:

a compressible element configured to apply compression to a calf muscle in a limb of a user;

a sensor to sense a heart rate of a heart of the user;

a controller configured to control a sequence, rate or amount of the compression of the compressible element based on timing of a heartbeat during perambulatory motion; and a generator configured to move a working fluid to the compressible element as controlled by the controller to cause the compression, the working fluid is electric charge and the compressible element comprises material which constricts in response to the electric charge to cause the compressible element to apply the compression;

wherein the sequence or rate of compression is established for the compressible element to apply the compression to the calf muscle between heart beats when the calf muscle is unflexed during the perambulatory motion to increase a supply of blood flow to the heart and to release the compression when the calf muscle is flexed during the perambulatory motion wherein the sequence or rate of compression of the compressible element is established to increase blood flow efficiency to be sustained through a peak output flow of the blood flow of the heart of the user during the perambulatory motion.

2. The system according to claim 1, wherein a physiological cycle of the muscle is determined by the controller when controlling the sequence or rate of compression by the compressible element.

3. The system according to claim 2, wherein the physiological cycle being a function of at least one prior compression of the compressible element and activation of the generator.

4. The system according to claim 3, wherein the controller receives feedback information from the compressible element and information from the generator to determine the physiological cycle; and further comprising a footwear comprising a sensing device comprising a plurality of strips disposed in a sole of the footwear wherein a position of a foot in a movement cycle of the perambulatory motion is sensed by at least one strip of the plurality of strips wherein the position is provided to the controller for use in controlling compressions of the compressible element to apply pressure between the heart beats when the calf muscle is unflexed.

5. The system according to claim 1, further comprising a storage device configured to retain the working fluid from the generator wherein the generator harvests the electrical charge during movement of the user.

6. The system according to claim 1, further comprising at least one sensor configured to measure a pulse rate, blood pressure, and/or compression rate of the compressible element.

7. A system comprising:

a sensing device to sense a heart rate of a heart of a user during perambulatory motion;

a footwear having a generator to harvest electric charges during a movement cycle of a foot of the user and having a plurality of strips to sense a position of the foot within a movement cycle during the perambulatory motion;

a compressible element to assert pressure on a vein in association with a limb muscle of the user to produce increased blood flow within the vein, the compressible element comprises material which constricts in response to an electric charge to cause the compressible element to assert the pressure; and a controller to control a sequence or rate of compression of the compressible element using the position of the foot and the heart rate to increase a supply of blood flow to the heart during the perambulatory motion wherein the limb muscle is a calf muscle; and the generator moves the electric charge to apply the pressure by the compressible element as controlled by the controller such that the pressure is asserted to the calf muscle between heart beats when the calf muscle is unflexed during the perambulatory motion and released when the calf muscle is flexed during the perambulatory motion.

8. The system according to claim 7, wherein the sequence or rate of compression of the compressible element is established as a function of a peak output blood flow of the heart of the user in relation to a peak efficiency heart rate of the heart at a heart rate closest to where the peak efficiency heart rate of the heart is realized during the perambulatory motion.

9. The system according to claim 7, wherein the sequence or rate of compression of the compressible element is established to increase blood flow efficiency to be sustained through a peak output flow of the blood flow of the heart of the user.

10. The system according to claim 7, further comprising at least one sensor configured to measure a pulse rate, blood pressure, and/or compression rate of the compressible element and wherein information from the sensor is provided to the controller.

11. The system according to claim 7, wherein the generator is in a sole of the shoe.

12. The system according to claim 7, further comprising a storage device configured to retain a form of the working fluid.

13. A method comprising:

creating movement of a working fluid with a generator;

sensing by a sensor a heart rate of a heart of a user during perambulatory motion;

supplying the working fluid to activate a compressible element surrounding a muscle in a limb of a user to apply compression to the muscle wherein the working fluid is electric charge and the compressible element comprises material which constricts in response to the electric charge to cause the compressible element to apply the compression;

controlling a sequence or rate of compression of the compressible element based on timing of a heartbeat to apply the compression to the muscle between heart beats when the muscle in the limb is unflexed during the perambulatory motion to increase a supply of blood flow to the heart and to reduce an amount of effort expended by the heart of the user and to release the compression when the muscle is flexed during the perambulatory motion; and establishing the sequence or rate of compression of the compressible element as a function of a peak output blood flow of the heart of the user to increase blood flow efficiency to be sustained through a peak output flow of blood flow of the heart of the user.

14. The method according to claim 13, wherein creating movement further comprises disposing the generator within a sole of a piece of footwear such that perambulatory motion of a foot of the user provides pressure to the generator to create the movement of the working fluid.

15. The method according to claim 13, further comprising retaining a form of the working fluid in a storage device to provide power to the compressible element; and harvesting the electric charge by the generator during the perambulatory motion.

* * * * *